US005236033A

United States Patent [19]

Goy et al.

[11] Patent Number: 5,236,033

[45] Date of Patent: Aug. 17, 1993

[54] METHOD FOR PRODUCING A BODY FROM A MATERIAL SUSCEPTIBLE TO THERMAL CRACKING AND CASTING MOLD FOR EXECUTING THE METHOD

[75] Inventors: Karl-Heinz Goy; David F. Lupton, both of Gelnhausen; Michael Hörmann, Mömbris; Willibald Kowarschik, Langenselbold; Klaus Rzesnitzek, Maintal; Berthold Zurowski, Brunchköbel, all of Fed. Rep. of Germany

[73] Assignee: W. C. Heraeus GmbH, Hanau am Main, Fed. Rep. of Germany

[21] Appl. No.: 926,513

[22] Filed: Aug. 5, 1992

[30] Foreign Application Priority Data

Aug. 22, 1991 [DE] Fed. Rep. of Germany ..... 4127792

[51] Int. Cl.[5] ..... B22D 15/00; B22D 15/04

[52] U.S. Cl. ..... 164/122.1; 164/138; 164/123; 164/127

[58] Field of Search ..... 164/122, 122.1, 123, 164/125, 127, 138; 249/111

[56] References Cited

U.S. PATENT DOCUMENTS

| | | | |
|---|---|---|---|
| 2,951,272 | 9/1960 | Kiesler | 164/127 |
| 3,204,301 | 9/1965 | Flemings, Jr. et al. | 164/122.1 |
| 4,243,471 | 1/1981 | Ciszek | 156/616 R |
| 4,739,818 | 4/1988 | McGill | 164/101 |
| 4,824,735 | 4/1989 | McGill | 428/610 |
| 4,867,224 | 9/1989 | Wakita et al. | 164/122.1 |
| 5,111,871 | 5/1992 | Cook | 164/127 |

FOREIGN PATENT DOCUMENTS

| | | | |
|---|---|---|---|
| 3532131 | 3/1987 | Fed. Rep. of Germany . | |
| 207076 | 2/1984 | German Democratic Rep. . | |
| 257350 | 3/1987 | German Democratic Rep. . | |
| 0029546 | 2/1983 | Japan | 164/123 |
| 0011060 | 1/1989 | Japan | 164/122.1 |

OTHER PUBLICATIONS

WPI Abstract of DE 35 32 131, Swirtlich & Woditsch-/Bayer.

W. Kurz and B. Lux, "Gerichtete Erstarrung" [Directed Solidification], *Zeitschrift fur Metallkunde,* vol. 63, No. 9, pp. 509 to 515 (1972).

*Primary Examiner*—Mark Rosenbaum
*Assistant Examiner*—Erik R. Puknys
*Attorney, Agent, or Firm*—Frishauf, Holtz, Goodman & Woodward

[57] ABSTRACT

Methods are known for producing a body from a material susceptible to thermal cracking, in particular from an alloy, by casting a melt of the material in a mold with thermally insulated side walls and a bottom of material with good thermal conducting properties and cooling the melt in the casting mold, where the solid-liquid interface forming as the border between the melt and the already solidified material essentially extends parallel to the bottom and, in the course of the solidification of the melt, moves from the bottom in the direction of the exposed surface of the melt. In order to provide a simple and cost-effective method, for producing plate-shaped bodies of material susceptible to thermal cracking, which permits the casting of crack-free and homogeneous bodies, the melt is poured into a casting mold, the temperature of which in degrees Celsius corresponds maximally to a third of the liquidus temperature of the material and is cast in the shape of a rectangular plate with a plate thickness in the range between 5 mm and 20 mm, where in the course of solidification of the melt, the solid-liquid interface moves essentially in the direction of one of the long sides of the plate.

14 Claims, 1 Drawing Sheet

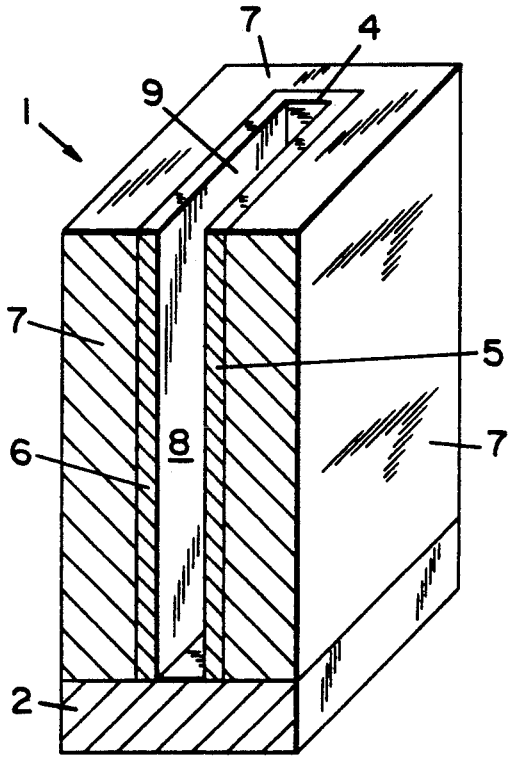
7
4
9
1
7
5
8
7
6
2

METHOD FOR PRODUCING A BODY FROM A MATERIAL SUSCEPTIBLE TO THERMAL CRACKING AND CASTING MOLD FOR EXECUTING THE METHOD

FIELD OF THE INVENTION

The invention relates to a method for producing a body from a material susceptible to thermal cracking, in particular from an alloy, by casting a melt of the material in a mold with thermally insulated side walls and a bottom of material with good thermal conducting properties and cooling the melt in the casting mold, where the solid-liquid interface forming as the border between the melt and the already solidified material essentially extends parallel to the bottom and in the course of the solidification of the melt moves from the bottom in the direction of the exposed surface of the melt. The invention also relates to a casting mold for executing the method.

BACKGROUND

A method of this type and a casting mold for executing it is known from East German Letters Patent 257 350, PFANNKUCHEN et al., together with East German Letters Patent 207 076, KRUMPHOLD et al., cited therein as prior art. A method for producing round disks of metal silicides with a diameter of 156 mm and a disk thickness of 8 mm is described in East German Letters Patent 207 076. In this case, a melt of a Cr-Si-W alloy is poured into a graphite mold preheated to ≧700° Celsius and thermally insulated on the outside and is evenly cooled to room temperature in a vacuum at a cooling rate of less than 20° C./min.

This method is well suited for producing thin disks; however, with cast bodies of larger wall thickness, cracks and bubbles appear in spite of preheating the mold and slow cooling. These can be caused, for example, by the unfavorable cast texture of the cast body, by a collection of deleterious precipitates, segregation, or pores in the center of the cast body or by the contraction of the cast body during cooling being impeded because of inhomogeneities on the interior walls of the casting mold.

To overcome these disadvantages, a cylindrical casting mold is proposed in East German Letters Patent 257 350, with a soft insulation layer glued to its inside, which does not offer great resistance to the contraction of the cast body, and into which a metal bottom plate of good thermal-conducting properties and of the same chemical composition as the material to be cast has been inserted. A directed solidification of the melt is attained by means of the specific thermal dissipation from the melt via the bottom plate in such a way that only a single solid-liquid interface is formed between the already solidified material and the molten material which, starting at the bottom of the casting mold moves essentially parallel to the bottom in the direction of the exposed melt surface in the course of continued solidification of the melt.

It is known from the publication "Gerichtete Erstarrung" [Directed Solidification], W. Kurz and B. Lux, *Zeitschrift fur Metallkunde,* Vol. 63, No. 9, pages 509 to 515 (1972), that such directed solidification can bring advantages regarding the segregation, secretion and bubble reactions of cast bodies. It is also known that directed solidification can cause cleaning of the cast body, in that the solid-liquid interface moving from the bottom of the casting mold in the direction of the exposed surface pushes foreign material, which is hard to dissolve in the solidified material, ahead of itself up to the surface of the melt. In this way, the foreign materials are concentrated at one end of the cast body, where they are less harmful in terms of the solidity properties of the cast body, and can be easily removed, if required. In the known processes for directed solidification, solidification of the material melts proceeds very slowly in order to keep the stresses generated in the cast body by casting and the subsequent cooling process small or to reduce them and to make the control of the specific, directed solidification easier. This is attained, for example, in that the casting mold is pre-heated before the melt is poured in and thereafter is cooled slowly and evenly. For example, a cooling speed to room temperature of less than 20° C./min is recited in East German Patent 207 076.

It is known from German Published, Non-Examined Patent Application DE-OS 35 32 131, SWIRTLICH et al., to maintain a temperature gradient over the height of the sidewalls of the casting mold, where the temperature at the upper edge of the casting mold lies in the range of the melting temperature of the material to be cast. By means of this, an exact control of the directed solidification of the melt is assured, starting at the bottom, with good thermal dissipation up to the upper edge of the casting mold. The melt solidifies very slowly in this case. In DE-OS 35 32 131, the speed, at which the solid-liquid interface proceeds, is stated to be 4 cm/h.

Depending on the material to be cast, a relatively large-grained structure is created by slow solidification and cooling which can also be a cause of the formation of cracks in the cast body. The force necessary for generating cracks is essentially dependent on the atomic bonds and the microstructure of the material. In connection with polycrystalline materials, grain boundaries can be regarded as intrinsically present incipient cracks, starting from which the spreading of cracks is facilitated. This property of grain boundaries of triggering cracks becomes more marked with lengthening of the individual grain boundaries, i.e. with a coarser grain structure of the material. In contrast thereto, the triggering of cracks or the spreading of cracks is hampered by fine-grained structures.

In addition, slow cooling can also aid the generation or growth of undesirable inhomogeneities, such as secretions or dissociations, in many materials susceptible to this, which results in fluctuations in the coating results when the material is used as a target for coating purposes, for example. Inhomogeneities of this type in the structure of the material can also encourage cracking.

Gaseous impurities, such as water vapor or oxygen, diffuse in larger amounts into the melt over the exposed melt surface, as well as the interior walls of the casting mold, because of the slow solidification of the melt, where they not only represent contamination of the material in the form of foreign materials, but can also act as nuclei for inhomogeneities forming in the material.

To avoid or reduce crack formation in the cast body, the use of a bottom plate with the same chemical composition as that of the metallic material to be cast is proposed in East German 257 350. A similar suggestion is also the basis of the method in accordance with European Patent Disclosure EP-B1 237 325, and corresponding U.S. Pat. Nos. 4,739,818 and 4,824,735, McGILL, where a bottom plate of a material is used which combines with the material to be cast to form a unified structure and which has a lesser expansion coefficient than that of the material to be cast. The surface of the cast body is placed under compressive strains because of this which, although they can prevent the spreading of thermal cracks over the entire thickness of the cast body, cannot prevent the generation of cracks.

Aside from the fact that, when bottom plates of the same chemical composition as that of the material to be cast are used, the thermal conductivity of the bottom plate cannot be optimized, there is also the danger of tearing of the bottom plate in the case of materials susceptible to thermal cracking because of the thermal stress when the hot melt is poured over it. With the use of bottom plates of a composition differing from that of the material to be cast, which are intended to be firmly connected with the latter, there are not only possible undesirable boundary reactions and adhesion problems, but also deformations of the cast bodies because of the different thermal expansion coefficients of the two material connected with each other, which can also result in problems when the cast bodies are brought to their intended use.

To produce disks of the material susceptible to thermal cracking, for example with the use as targets for coating purposes, a cylindrically shaped base body, such as produced by means of the casting mold in accordance with East German Patent 257 350, must be cut into appropriate disks or must be divided in some other manner. The material removed in the course of this, as well as the additional rejects as a result of the stress on the cast body during working, inevitably result in losses of material.

THE INVENTION

It is the object of the present invention to provide a simple and cost-effective method for producing plate-shaped bodies of material susceptible to thermal cracking, which permits the casting of crack-free and homogeneous bodies, and to provide a simple, low-wear casting mold for executing the method, from which the cast body is easily removed and which permits rapid cooling of the melt along with simultaneous directed solidification.

Briefly, this object is achieved by pouring the melt into a casting mold the temperature of which in degrees Celsius corresponds maximally to a third of the liquidus temperature of the material and that it is cast in the shape of a rectangular plate with a plate thickness in the range between 5 mm and 20 mm, where the solid-liquid interface moves essentially in the direction of one of the long sides of the plate in the course of solidification of the melt. In this case, the side walls of the casting mold as well as the bottom may be at the same temperature. It is also possible to keep the bottom cooler than the side walls or to cool it additionally while the melt cools. By pouring the melt into a casting mold, the temperature of which in degrees Celsius corresponds maximally to a third of the liquidus temperature of the material, the amount of heat to be dissipated by way of the bottom is kept as small as possible and rapid solidification of the melt is aided. However, in this case thermal dissipation preferably takes place in the direction towards the bottom of the casting mold, so that a solid-liquid interface is formed at the boundary between the melt and the already solidified material, which extends essentially parallel to the bottom and moves in the direction towards the exposed melt surface.

It has been surprisingly shown that no tension which might cause tearing of the cast body is induced in the cast body by the comparatively rapid solidification of the melt. Up to now, it had been assumed that cooling of melts consisting of materials susceptible to thermal cracking should take place as slowly as possible to prevent the tearing of the cast body in the course of cooling. An explanation as to why the rapid cooling in accordance with the method of the invention does not result in tearing of the cast body, but that, on the contrary, it is possible to produce cast bodies which have particularly few or no cracks at all, can be found in that solidification in a directed manner is sought to be achieved simultaneously with the rapid solidification of the cast body. This rapid directed solidification of the body results on the one hand in a homogeneous distribution of the individual components of the material in the cast body, and reduces the danger of a creation of dissociations or other inhomogeneities which could lead to an uneven distribution of the properties of the material inside the cast body and thus to the generation of stresses. On the other hand, it prevents the creation and spreading of a plurality of solid-liquid interfaces where very high tensions can occur at their intersecting points. However, it has been shown that homogeneous, crack-free cast bodies are only obtained if the melt solidifies in the shape of a rectangular plate with a plate thickness in the range between 5 mm and 20 mm and where the solid-liquid interface essentially moves in the direction of one of the long sides of the plate. This means that during solidification the bottom of the casting mold is in contact with one of the narrow sides of the plate-shaped cast body, so that the cast body solidifies while standing on edge. On the one hand, pouring the melt into a gap with a gap width up to approximately 20 mm permits the even filling of the casting mold; on the other hand, a mirror-symmetrical tension profile is generated in the cast body because of the solidification of the melt in the shape of a plate standing on edge, where the mirror surface extends parallel to the broad side of the plate-shaped cast body and exactly in the center of the plate. Such distribution of the tension generated by cooling in the cast body is least damaging in regard to the generation of cracks. Although disturbances of this tension profile occur on the narrow sides of the cast body, they hardly count if the long sides of the plate-shaped cast body are of sufficiently large dimensions.

Furthermore, rapid cooling of the melt prevents the possible formation of inhomogeneities, such as secretions or dissociations, or it at least decreases their speed of growth. In addition, the absorption of impurities into the melt via the gaseous phase, via the side walls or via the bottom of the casting mold is reduced with rapid cooling. Such impurities, such as water or oxygen, could change the homogeneous lattice structure of the material and thus have damaging effects in respect to the solidity properties of the cast body as well as its purity.

In a surprising manner, it has been found to be advantageous to pour the melt into a casting mold the temperature of which is at most 250° C. Particularly good results, in terms of homogeneity and freedom from cracks of the cast bodies, were achieved with pouring the melt into casting molds which had been kept at room temperature prior to casting.

Letting the melt solidify in the shape of a rectangular plate, the width of which corresponds to at least five times the plate thickness, has also proven to be advantageous, where the width of the plate is understood to be that lateral dimension which, together with the plate thickness, encompasses the plane extending parallel to the bottom. The mirror-symmetrical tension profile forming in the solidifying cast body is little affected by this. The length of the plate-shaped cast body, too, which is understood to be the lateral dimension of the cast body extending vertically or nearly vertically to the bottom, should advantageously correspond to at least five times the plate thickness. However, this length cannot always easily be observed for each material, since the length within which the directed solidification of the cast body takes place is a function of the thermal conductivity of the material, among others. In case of materials of poor thermal conductivity, the heat of the melt above the bottom clearly dissipates slower with increasing thickness of the already solidified layer, so that the solid-liquid interface moving in the direction of the exposed melt surface progresses slower and slower. Additional solid-liquid interfaces being formed at the side walls of the casting mold or from the direction of the melt surface prevent further directed solidification. Good results were obtained with materials having a thermal conductivity of more than 25 W/mK. Materials with a thermal conductivity in the range between 40 W/mK and 60 W/mK are preferably employed. The length within which directed solidification takes place can be easily and individually determined for each material by taking grinding samples of a few test castings.

One method has proven to be particularly effective, where the material to be cast is selected to be a composition of at least one transition metal and at least one rare earth metal, and particularly a material with a composition containing between 25 weight-% and 65 weight-% of iron, between 35 weight-% and 60 weight-% of terbium and at most 15 weight-% of cobalt. By using such a material, it was possible to achieve very homogeneous cast bodies, showing extraordinarily good homogeneity and deviation of the composition inside the cast body of less than half a percent from the set values of the respective metals.

With respect to the casting mold for executing the method, the above mentioned object is attained by the invention in that the bottom consists of a metal which does not enter into a mechanical bond with the melt of the material, and in that the casting mold is provided with four side walls, placed opposite each other in pairs, the interior walls of which have a mean peak-to-valley depth of at most 100 micrometers and enclose a space with a rectangular base surface the short leg of which has a length of between 5 mm and 20 mm and where the length of the long leg and the height of the space enclosed by the side walls are at least five times the length of the short leg.

The embodiment of the casting mold with side walls having a mean peak-to-valley depth of at most 100 micrometers permits more rapid cooling of the material melt or of the solidified cast body, because the danger of triggering cracks starting at the surface has been reduced with smooth surfaces of the cast body. Furthermore, back tapers and back indentations and therefore obstacles to the contraction of the cast body during cooling are avoided. Due to the fact that the bottom consists of a metal which does not form a mechanical bond with the melt of the material, the easy removal of the cast body from the casting mold is assured. The bottom plate can be optimized in respect to its thermal conductivity and in regard to its thermal shock resistance when hot melt is poured over it and it can be repeatedly used. Furthermore, there is no danger of a deformation of the cast bodies because of different thermal expansion coefficients of materials connected with each other, nor the danger of a boundary surface reaction between the cast body and the bottom. Due to the fact that the side walls are placed opposite each other in pairs and enclose a space with a rectangular base surface, the short leg of which is between 5 mm and 20 mm long and where the length of the long leg and the height of the space enclosed by the side walls are at least five times the length of the short leg, easy pouring of the melt of the material and even filling of the casting mold from the bottom up is made possible.

Casting molds, the side walls of which consist of glass, in particular quartz glass or smoothly polished graphite or boron nitride, have particularly smooth interior walls. Casting molds having side walls of this type are dimensionally stable even at high temperatures, in particular in casting bodies with long lateral dimensions. Back tapers and back indentations are almost impossible with such casting molds, the casting molds can be removed very easily and have a very smooth surface. Because of this the generation of cracks in the cast body starting at the surface is reduced and more rapid cooling of the cast bodies is made possible. Furthermore, graphite and boron nitride are particularly soft materials which put up little resistance to the contraction of the cast body during cooling.

It has also been shown to be advantageous to provide the insides of the side walls with a separating layer, in particular with a separating layer containing boron nitride powder. A separating layer of this type can further reduce the resistance against contraction of the cooling cast body put up by the side walls.

In regard to a directed solidification of the cast body it is necessary to keep the thermal dissipation via the side walls as low as possible. For this reason an embodiment of the casting mold is preferred in which the side walls have a thickness in the range between 2 mm and 6 mm. By means of this, it is attained that the side walls heat up very quickly when the melt is poured in and further thermal dissipation via the side walls is reduced.

In connection with simple manipulation of the casting mold and easy removal of the cast body it has been shown to be advantageous to embody the bottom and the side walls so they can be removed from each other. Furthermore, an embodiment has shown to be advantageous in which the bottom encloses an angle of less than 90° with at least two oppositely located side walls, so that the cast body which has solidified between the side walls is conically slightly widened, looking in the direction of the bottom, and therefore the side walls can be easily lifted off it upwardly.

The execution of the method in accordance with the invention, as well as the casting mold used therefor, will be described below by way of example by means of a schematic illustration.

DRAWING

The single drawing figure shows a schematic section of a casting mold.

DETAILED DESCRIPTION

The drawing figure shows a section of a casting mold 1, where four side walls 4, 5, 6, which are located opposite each other in pairs (because of the sectional view, one side wall has not been drawn) on a bottom 2 of copper, which has a total mass of approximately 4000 g of copper and is used as a heat sink. The side walls 4, 5, 6, consisting of 4 mm thick quartz glass panes with a mean peak-to-valley depth of 10 micrometers, are surrounded by an insulating layer 7. The side walls 4, 5, 6 enclose a space 8 with a rectangular bottom surface, the short leg of which is 9 mm long and the long leg is 90 mm long. The inner walls of the side walls 4, 5, 6 are covered with a thin layer 9 of boron nitride powder. The inner walls of the wider side walls 5, 6 located opposite each other do not extend parallel to each other, but each encloses, together with the bottom 2, an angle of 89°, so that the space 8 enclosed by the side walls 4, 5, 6 slightly widens conically toward the bottom.

The execution of the method in accordance with the invention will be described below by way of an example and by means of the casting mold 1 shown in the drawing. An alloy of the composition of 50 weight-% of iron, 45 weight-% of terbium and 5 weight-% of cobalt, the melting point of which is approximately 1300° C., is melted in a vacuum by inductive heating. The melt is poured at a temperature of approximately 1400° C. into the casting mold 1, where the bottom 2 as well as the side walls 4, 5, 6 of the casting mold 1 are each a room temperature. Because of the pouring of the melt, which has a weight of approximately 1500 g, the bottom 1 of the casting mold is heated to a little more than 200° C. Within the first minute after pouring in the melt, it solidifies in a directed manner with a mean speed of approximately 5 mm per second. In the course of this, the solid-liquid interface moves from the bottom in the direction of the exposed melt surface. However, with increasing thickness of the already solidified layer, thermal dissipation through the bottom becomes slower, so that the solidification speed decreases in the direction perpendicular to the bottom 2. Solidification of the melt and cooling of the cast body takes place without the additional provision of exterior heat. Because of the small thickness of the walls 4, 5, 6, they are heated up by means of the heat provided by the melt to such an extent that there is scarcely any solidification from the direction of the side walls. Therefore, the melt solidifies at the greatest possible speed over its entire height in an almost directed manner. Because of the rapid solidification of the melt, a mirror-symmetrical tension profile is formed in the cast body during cooling. In this case, the mirror plane extends parallel to and centered in respect to the broad side walls 5, 6. This distribution of the tension makes possible the rapid solidification of the melt and the production of an extremely fine-grained structure free of inhomogeneities, such as secretions or dissociations. The thickness of the plate produced in this way is approximately 8.5 mm, its width approximately 88 mm and the height within which the melt solidifies in a directed manner is approximately 180 mm. It can be directly used as a target for coating purposes, following negligible finishing.

Cast bodies produced by means of the method of the invention and made of this alloy display barely measurable differences in the chemical composition in the area of the solidified bottom and in the area of the last solidified exposed melt surface. For example, differences in the concentration of terbium of less than 0.3% of the weighted in amount were measured between these two areas. Good homogeneity or this type can only be produced by rapid solidification.

Various changes and modifications may be made, and features described in connection with any one of the embodiments may be used with any of the others, within the scope of the inventive concept.

We claim:

1. A method for producing a body from a material susceptible to thermal cracking, by casting a melt of the material in a casting mold (1) with thermally insulated side walls (4,5,6) and a bottom (2) of material with good thermal conducting properties and cooling the melt in the casting mold, where the solid-liquid interface forming as the border between the melt and the already solidified material extends parallel to the bottom and, in the course of the solidification of the melt, the interface propagates from the bottom in the direction of the exposed upper surface of the melt, comprising the steps of dimensioning said mold (1) with a first horizontal gap of no more than about 20 mm between a most-closely-adjacent pair (5,6) of said sidewalls, with a second horizontal gap, measured perpendicular to said first gap, at least five times as great as said first gap, and with a vertical height which is at least a multiple of said first gap, bringing said casting mold (1) to the temperature which, in degrees Celsius, corresponds maximally to a third of the liquidus temperature of the material, and pouring said melt into said casting mold (1), thereby producing directed solidification of said melt into a platelike solid having a thickness in the range between 5 mm and 20 mm.

2. A method in accordance with claim 1, wherein the casting mold (1) is at a temperature of at most 250° Celsius prior to casting.

3. A method in accordance with claim 1, wherein the casting mold (1) is maintained at room temperature prior to casting.

4. A method in accordance with claim 1, wherein the melt is cast on edge in the shape of a rectangular plate, the horizontal width of which corresponds to at least five times the plate thickness.

5. A method in accordance with claim 1, wherein a combination of at least one transition metal and at least one rare earth metal is used as the material to be cast.

6. A method in accordance with claim 5, wherein a composition, containing between 25 weight-% and 65 weight-% of iron, between 35 weight-% and 60 weight-% of terbium, and at most 15 weight-% of cobalt, is selected as the material to be cast.

7. A method in accordance with claim 1, wherein a composition having a thermal conductivity of at least 25 W/mK, and not more than 60 W/mK, is selected as the material.

8. A casting mold for causing rapid directed solidification of a melt into an edge-oriented platelike solid, having thermally insulated smooth side walls (4,5,6) and a bottom (2) of metal with good thermal conductivity, wherein the bottom (2) consists of a metal, which does not enter into a mechanical bond with the melt, and the casting mold (1) is provided with four of said side walls (4, 5, 6), placed opposite each other in pairs, the inward-facing surfaces of which have a mean peak-to-valley depth of at most 100 micrometers and enclose a space (8) with a rectangular base surface, the major dimensions of which are a short horizontal leg and a long horizontal leg; said short leg has a length of between 5 mm and 20 mm and where the length of the long leg and the height, of the space (8) enclosed by the side walls (4, 5, 6), are both at least five times the length of the short leg.

9. A casting mold in accordance with claim 8, wherein the casting mold (1) has side walls of a material selected from the group consisting of glass, graphite, and boron nitride.

10. A casting mold in accordance with claim 8, wherein the inward facing surfaces are provided with a separating layer (9).

11. A casting mold in accordance with claim 10, wherein the separating layer (9) contains boron nitride powder.

12. A casting mold in accordance with claim 8, wherein the side walls (4, 5, 6) have a thickness in the range of between 2 mm and 6 mm.

13. A casting mold in accordance with claim 8, wherein the bottom (2) and the side walls (4, 5, 6) are separable from each other.

14. A casting mold in accordance with claim 13, wherein the bottom (2) encloses an angle of less than 90 degrees with at least two oppositely located side walls (5, 6).

* * * * *